US010890371B2

(12) United States Patent
Takami et al.

(10) Patent No.: US 10,890,371 B2
(45) Date of Patent: Jan. 12, 2021

(54) FREEZING REFRIGERATOR

(71) Applicant: PANASONIC CORPORATION, Osaka (JP)

(72) Inventors: Fuminori Takami, Osaka (JP); Terutsugu Segawa, Osaka (JP)

(73) Assignee: PANASONIC CORPORATION, Osaka (JP)

( * ) Notice: Subject to any disclaimer, the term of this patent is extended or adjusted under 35 U.S.C. 154(b) by 52 days.

(21) Appl. No.: 16/210,754

(22) Filed: Dec. 5, 2018

(65) Prior Publication Data

US 2019/0170425 A1 Jun. 6, 2019

(30) Foreign Application Priority Data

Dec. 5, 2017 (JP) ..... 2017-233501
Oct. 5, 2018 (JP) ..... 2018-190298

(51) Int. Cl.
*F25B 39/02* (2006.01)
*F25D 17/06* (2006.01)
(Continued)

(52) U.S. Cl.
CPC ..... *F25D 17/062* (2013.01); *F25B 41/003* (2013.01); *F25D 17/045* (2013.01); *F25D 21/08* (2013.01); *F25B 39/02* (2013.01); *F25B 2400/052* (2013.01); *F25B 2400/054* (2013.01); *F25D 2317/0681* (2013.01)

(58) Field of Classification Search
CPC ..... F25C 2400/052; F25C 2400/054; F25C 39/02; F25B 2400/052; F25B 2400/054; F25B 39/02
See application file for complete search history.

(56) References Cited

U.S. PATENT DOCUMENTS 2,446,853 A * 8/1948 Savidge ..... F25B 41/067 62/474
2,448,315 A * 8/1948 Kunzog ..... F25B 41/067 165/119
(Continued)

FOREIGN PATENT DOCUMENTS

CN 1849487 A 10/2006
CN 206637895 U 11/2017
(Continued)

OTHER PUBLICATIONS

English translation of Search Report which is an annex to Office Action dated Jun. 23, 2020 for the corresponding Chinese Patent Application No. 201811469091.8.

*Primary Examiner* — Cassey D Bauer
(74) *Attorney, Agent, or Firm* — McDermott Will and Emery LLP

(57) ABSTRACT

A freezing refrigerator heats an entrance side pipe of evaporator, which is difficult to heat in the related art, with the condensation latent heat of refrigerant that builds up in a lower portion of evaporator in a liquid state while being vaporized with the heat of defrosting heater so as to warm the outlet pipe by a second thermal coupling part thermally coupling an inlet pipe and an outlet pipe of evaporator, whereby temperature variation of the entire evaporator in a defrosting operation can be suppressed, and the power consumption of defrosting heater can be reduced.

5 Claims, 6 Drawing Sheets

(51) Int. Cl.
*F25D 17/04* (2006.01)
*F25D 21/08* (2006.01)
*F25B 41/00* (2006.01)

(56) References Cited

U.S. PATENT DOCUMENTS 2,525,560 A * 10/1950 Pabst ..... F25B 47/025 62/278
2,641,109 A * 6/1953 Muffly ..... F25D 11/006 62/199
2,799,999 A * 7/1957 Swanson ..... F25B 43/006 62/503
2,871,680 A * 2/1959 Zearfoss, Jr. ..... F25B 45/00 62/513
2,990,698 A * 7/1961 Crotser ..... F25B 43/006 62/503
3,145,545 A * 8/1964 Jaeger ..... F25B 40/00 62/323.4
5,269,158 A * 12/1993 Bitter ..... F25B 41/067 62/511
2005/0109486 A1* 5/2005 Memory ..... F25B 40/00 165/62
2006/0032268 A1* 2/2006 Cole ..... F25B 41/067 62/513
2007/0006611 A1 1/2007 Zimmermann
2007/0180853 A1* 8/2007 Lim ..... F25B 40/00 62/513
2007/0215333 A1* 9/2007 Viklund ..... F25B 41/067 165/172
2011/0126575 A1* 6/2011 Kobayashi ..... F25B 9/006 62/333
2012/0073317 A1* 3/2012 Lee ..... F25D 23/061 62/115
2015/0059371 A1* 3/2015 Wu ..... F25B 41/00 62/115
2016/0282031 A1* 9/2016 Cernuschi ..... F25D 15/00

FOREIGN PATENT DOCUMENTS

JP 10-038453 A 2/1998
JP 2008-057911 A 3/2008

* cited by examiner

FREEZING REFRIGERATOR

CROSS REFERENCE TO RELATED APPLICATIONS

This application is entitled to and claims the benefit of Japanese Patent Application No. 2017-233501, filed on Dec. 5, 2017 and Japanese Patent Application No. 2018-190298, filed on Oct. 5, 2018, the disclosure of which including the specification, drawings and abstract is incorporated herein by reference in its entirety.

TECHNICAL FIELD

The present invention relates to a freezing refrigerator. In particular, the present invention relates to a freezing refrigerator having a defrosting function.

In a known defrosting method of a freezing refrigerator, an inflow prevention valve for preventing inflow of refrigerant into an evaporator is closed to forcibly reduce the refrigerant in the evaporator in an operating compressor such that defrosting is performed using the heat generated by a defrosting heater (see, for example, PTL 1).

FIG. 7 is a freezing cycle piping diagram illustrating a defrosting method of the conventional freezing refrigerator disclosed in PTL 1.

The freezing refrigerator illustrated in FIG. 7 includes compressor 101, condenser 102, dryer 103, decompressor 104 (capillary tube), evaporator 105, and defrosting heater 106. Inflow prevention valve 107 is installed between condenser 102 and dryer 103. With compressor 101 in an operation state, inflow prevention valve 107 is closed, and the refrigerant in evaporator 105 is forcibly reduced. In this state, defrosting is performed using the heat generated by defrosting heater 106. In this manner, the heat of defrosting heater 106 is prevented from being used for the vaporization heat of the refrigerant in evaporator 105.

CITATION LIST

Patent Literature

PTL 1
Japanese Patent Application Laid-Open No. H10-38453

SUMMARY OF INVENTION

Technical Problem

However, in the conventional configuration, the refrigerant in evaporator 105 is reduced when defrosting is performed, and consequently the effect of vertically uniformizing the heat of the refrigerant in evaporator 105 is reduced. When the effect is reduced, temperature is varied by delay in temperature rise in the upper portion of evaporator 105 and insufficient temperature rise at the entrance of evaporator 105 where a large amount of adhering frost presents. As a result, the total time taken for the defrosting of evaporator 105 is lengthened, and the interior of the refrigerator and/or the freezer is heated, and consequently, the power required for re-cooling is increased.

Since the defrosting time is also lengthened, the energization time of defrosting heater 106 is lengthened, and accordingly the power consumption of the heater is increased. In addition, the defrosting is terminated even when the frost partially remains due to the temperature variation, and the cooling load after the defrosting might be increased.

To solve the above-mentioned problems, an object of the present invention is to provide a freezing refrigerator for efficiently using the heat of a defrosting heater without wasting the heat.

Solution to Problem

To achieve the above-mentioned object, a freezing refrigerator of an embodiment of the present invention includes: a compressor; a condenser; a dryer; a decompressor; an evaporator; a first pipe including an inlet pipe of the evaporator; a second pipe including an outlet pipe of the evaporator; a first thermal coupling part configured to thermally couple the decompressor and the second pipe together; and a second thermal coupling part configured to thermally couple the first pipe and the second pipe together. The compressor, the condenser, the dryer, the decompressor and the evaporator configure a refrigerant cycle.

According to the above-mentioned configuration, with the outlet side pipe warmed with the condensation latent heat of the refrigerant vaporized with the heat of the defrosting heater in the lower portion of the evaporator, it is possible to increase the temperature of the inlet pipe at a portion where no fin is provided on the entrance side of the evaporator where the temperature is difficult to be raised in the upper portion of the evaporator.

Advantageous Effects of Invention

With the evaporator of the freezing refrigerator of an embodiment of the present invention having the above-mentioned configuration, the heat of the defrosting heater in a defrosting operation can be efficiently used without wasting the heat.

DESCRIPTION OF EMBODIMENTS

Embodiments of the present invention are described below with reference to the drawings.

Embodiment 1

Figure 1:
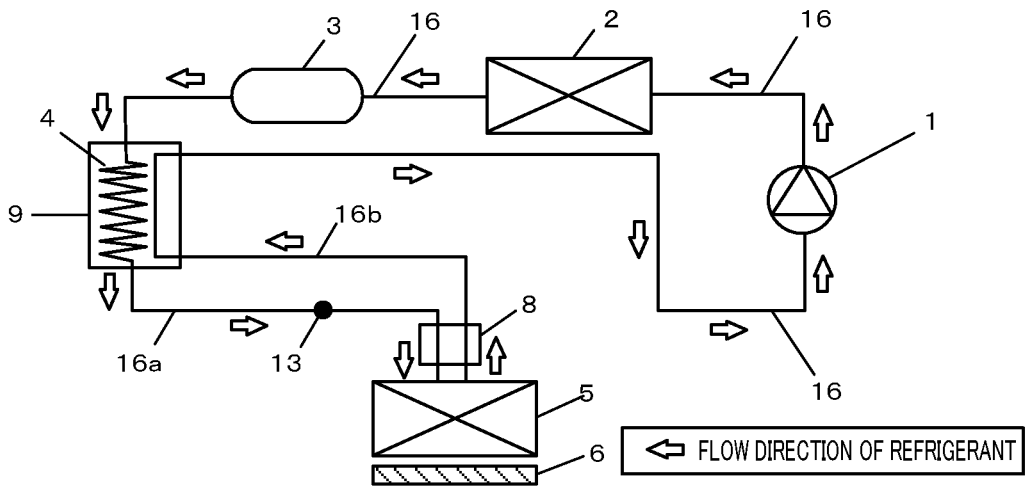
FIG. 1 is a piping diagram of a freezing cycle of Embodiment 1 of the present invention.
Figure 2A:
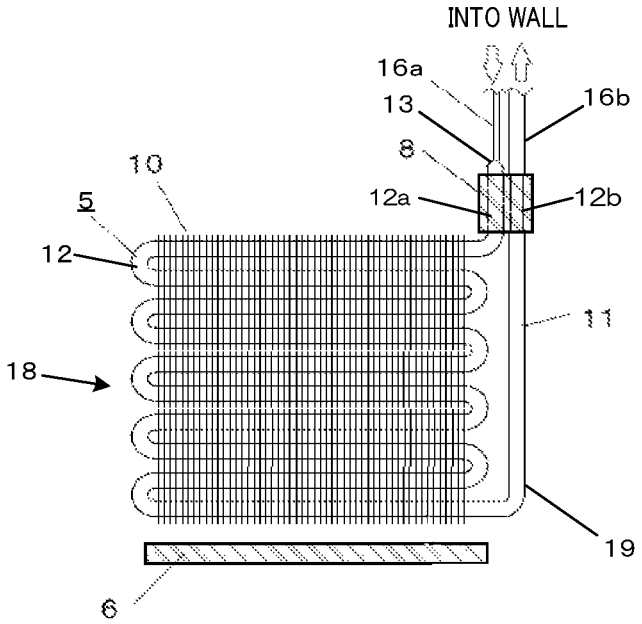
FIG. 2A is a front view of an evaporator of Embodiment 1 of the present invention.
Figure 2B:
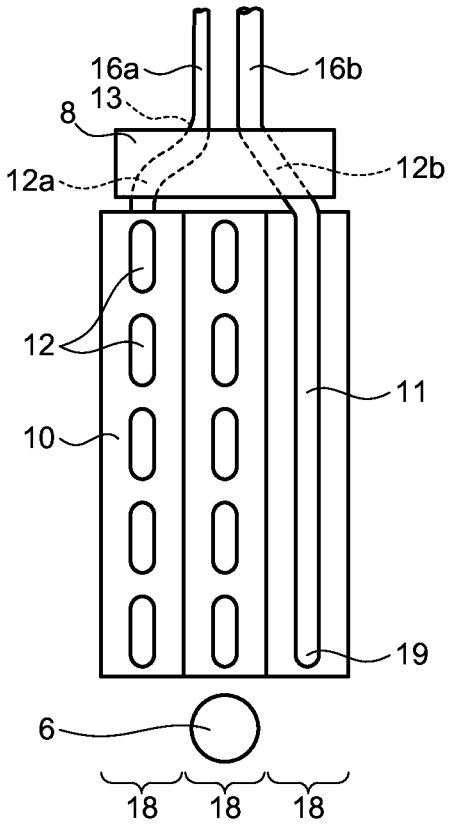
FIG. 2B is a side view of the evaporator of Embodiment 1 of the present invention.

FIG. 1 illustrates piping of a freezing cycle of Embodiment 1 of the present invention and components thereof. FIG. 2A is a front view of evaporator 5. FIG. 2B is a side view of evaporator 5.

In FIG. 1, the freezing refrigerator includes compressor 1, condenser 2, dryer 3, decompressor 4 (for example, a capillary tube), evaporator 5, defrosting heater 6, first thermal coupling part 9, second thermal coupling part 8, and pipe 16. Compressor 1, condenser 2, dryer 3, decompressor 4, and evaporator 5 are connected with one another with pipe 16. Refrigerant passes through the inside of pipe 16. Pipe 16 includes first pipe 16*a* and second pipe 16*b*. First pipe 16*a* connects the refrigerant outlet of decompressor 4 and the refrigerant entrance of evaporator 5. Second pipe 16*b* connects the refrigerant outlet of evaporator 5 and the entrance of compressor 1. It is to be noted that, here, first pipe 16*a* includes inlet pipe 12*a* of evaporator 5. In addition, second pipe 16*b* includes outlet pipe 12*b* of evaporator 5.

Compressor 1 compresses the refrigerant of vapor phase in the freezing cycle, and serves a function of circulating the refrigerant in the freezing cycle.

Condenser 2 condenses and liquefies compressed refrigerant of vapor phase and liberates the condensation latent heat of the refrigerant.

Dryer 3 sucks moisture in the freezing cycle.

Decompressor (for example, capillary tube) 4 reduces the pressure of the refrigerant of liquid phase.

Evaporator 5 vaporizes the depressurized refrigerant of liquid phase to reduce the temperature inside the refrigerator by using the vaporization latent heat of the refrigerant.

Defrosting heater 6 is designed for melting the frost adhering to evaporator 5, and is disposed below evaporator 5 in the present embodiment.

First thermal coupling part 9 thermally couples decompressor 4 and second pipe 16*b*. In the cooling operation in which compressor 1 is operating, heat exchange is performed between the high temperature refrigerant passing through decompressor 4 and the low temperature refrigerant discharged from the outlet of evaporator 5 to thereby improve the cooling down performance. First thermal coupling part 9 couples the pipes and transmits heat. Examples of the material of first thermal coupling part 9 include metal and carbon materials.

As illustrated in FIG. 2A, the pipe upstream of inlet pipe 12*a* is provided with expanding portion 13. The pipe diameter increases at expanding portion 13, and the pipe with the increased diameter is connected with pipe 12 of evaporator 5. Expanding portion 13 is a portion having a larger diameter in first pipe 16*a*. The diameter of expanding portion 13 is larger (for example, about two to five times larger in cross-sectional area) on the upstream side than on the downstream side. Expanding portion 13 is designed for expanding the refrigerant flowing inside decompressor 4.

As illustrated in FIG. 2A, second thermal coupling part 8 thermally couples the pipe downstream of expanding portion 13 and outlet pipe 12*b*. In the defrosting operation in which compressor 1 is stopped and defrosting heater 6 is energized, the heat of defrosting heater 6 is transmitted from outlet pipe 12*b* to the pipe downstream of expanding portion 13 (which is provided in inlet pipe 12*a*). Accordingly, temperature rise is not delayed in the upper portion of evaporator 5 remote from heater 6 and temperature rise is not insufficient at the entrance of evaporator 5 where a large amount of frost is adhering. Thus, temperature variation can be suppressed. As a result, the heat of defrosting heater 6 is efficiently used. It is to be noted that second thermal coupling part 8 couples the pipes and transmits heat as with first thermal coupling part 9. Examples of the material of second thermal coupling part 8 include metal and carbon materials.

By performing a cooling operation with the freezing cycle having the above-mentioned configuration, and by performing heat exchange with the cold air generated by evaporator 5 by using the fan such that the air circulates in the freezing refrigerator, foods are stored in a frozen or cooled state.

Here, as the moisture from foods adheres to evaporator 5 in the form of frost and the frost grows, the heat exchange performance of evaporator 5 decreases. To restore the reduced heat exchange performance, defrosting is performed by temporarily stopping the cooling operation (that is, compressor 1 is stopped), and by energizing defrosting heater 6 to heat evaporator 5. This procedure of the operation is referred to as the defrosting operation. In the defrosting operation, the liquid refrigerant inside evaporator 5 is also vaporized.

Structure of Evaporator 5

FIG. 2A is a front view of evaporator 5 of Embodiment 1. In evaporator 5, a horizontal pipe in which one pipe 12 horizontally meanders in ten-folds in the vertical direction is arranged in one-line in the front-rear direction. A heat-exchange facilitation fin is attached on pipe 12. Evaporator 5 is a heat exchanger of a fin-and-tube type, and FIG. 2A illustrates pipe 12 viewed from the front. Inlet pipe 12*a* is located at the entrance on decompressor 4 side. Inlet pipe 12*a* is connected with pipe 12, and pipe 12 meanders downward as described above. Pipe 19, which is an end portion of pipe 12, is located on the bottom side. Pipe 19 is connected with returning vertical pipe 11 which extends straight without meandering in the vertical direction (from bottom to top). Returning vertical pipe 11 is connected with outlet pipe 12*b*.

FIG. 2B is a side view of another exemplary evaporator 5. As compared with FIG. 2A in which pipe line 18, which is a cluster of pipe 12, is disposed in one-line, pipe line 18 illustrated in FIG. 2B is disposed in three lines in the front-rear direction. Pipe 12 is connected at the lower portion of pipe line 18 of the first line and the lower portion of pipe line 18 of the second line. Pipe 12 is connected at the upper portion of pipe line 18 of the second line and the upper portion of pipe line 18 of the third line.

In a case that pipe line 18 is disposed in odd-numbered lines, outlet pipe 12*b* of evaporator 5 located at the lower portion and inlet pipe 12*a* disposed at the upper portion of evaporator 5 are largely separated away from each other in vertical direction. In the present embodiment, pipe 19 of the outlet side end portion of evaporator 5 located at the lower portion is connected with returning vertical pipe 11 extending in the vertical direction (from bottom to top). Returning vertical pipe 11 is connected with outlet pipe 12*b*. As a result, inlet pipe 12*a* (the pipe downstream of expanding portion 13) and outlet pipe 12*b* are close to each other, and thus second thermal coupling part 8 in which inlet pipe 12*a* and outlet pipe 12*b* are thermally coupled with each other is provided.

A part of returning vertical pipe 11 and a part of inlet pipe 12*a* are welded and thermally coupled with each other at thermal coupling part 8 (corresponding to "coupling part" of the present invention).

Figure 3A:
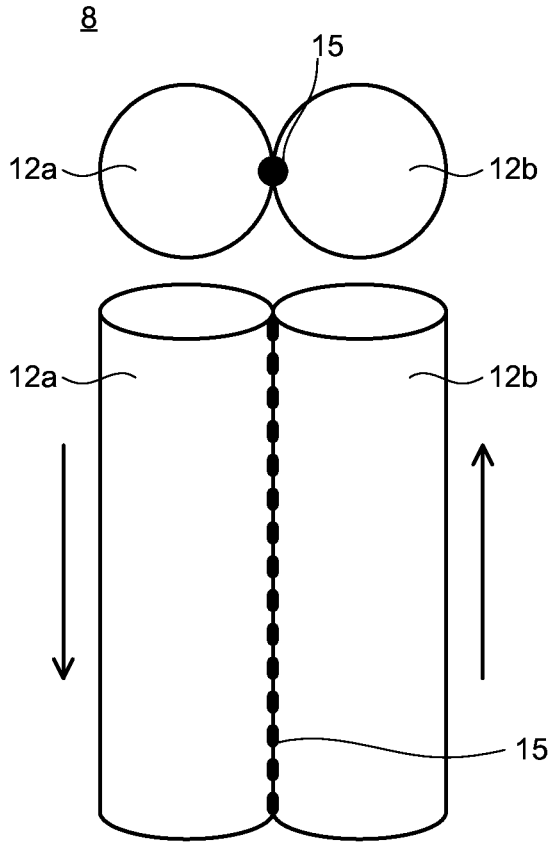
FIG. 3A illustrates an example of a second thermal coupling part of Embodiment 1 of the present invention.
Figure 3B:
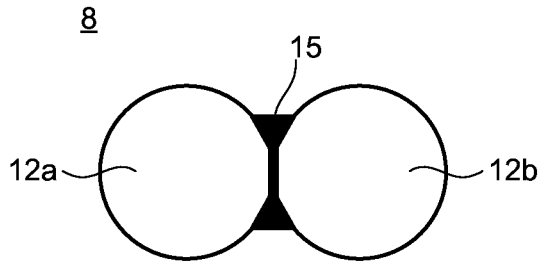
FIG. 3B illustrates an example of the second thermal coupling part of Embodiment 1 of the present invention.
Figure 3C:
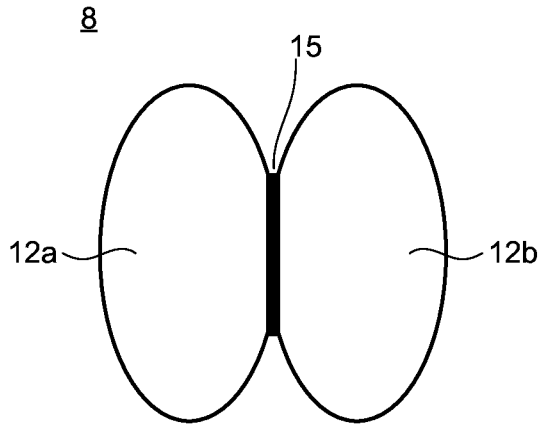
FIG. 3C illustrates an example of the second thermal coupling part of Embodiment 1 of the present invention.

FIG. 3A to FIG. 3C illustrate an example of second thermal coupling part 8. FIG. 3A illustrates, on the upper side, a cross-section of second thermal coupling part 8 taken along a plane orthogonal to the refrigerant distribution direction, and FIG. 3A illustrates, on the lower side, a perspective view of second thermal coupling part 8.

Second thermal coupling part 8 includes welding part 15. As illustrated in FIG. 3A, welding part 15 joins outlet pipe 12*b* and inlet pipe 12*a*. Welding part 15 is provided in a rod shape along the contacting portion between outlet pipe 12*b* and inlet pipe 12*a*.

In addition, second thermal coupling part 8 may include welding part 15. As illustrated in FIG. 3B, welding part 15 includes a part provided in a rod shape along the contacting portion between outlet pipe 12*b* and inlet pipe 12*a*, and triangular prism portions provided on both sides of the part. Welding part 15 is provided by padding. Thus, the contacting area between outlet pipe 12*b* and inlet pipe 12*a* through welding part 15 increases, and the heat exchange effect can be enhanced.

In addition, second thermal coupling part 8 may include welding part 15. Welding part 15 joins the flat surface obtained by radially pressing outlet pipe 12*b* and the flat surface obtained by radially pressing inlet pipe 12*a*. Thus, the contacting area between outlet pipe 12*b* and inlet pipe 12*a* through welding part 15 increases, and the heat exchange effect can be enhanced.

Figure 4A:
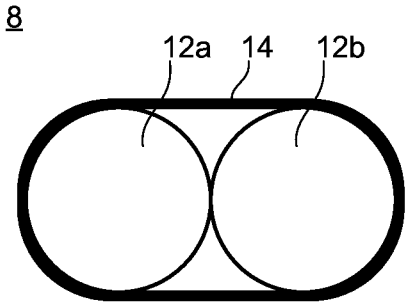
FIG. 4A illustrates an example of the second thermal coupling part of Embodiment 1 of the present invention.
Figure 4D:
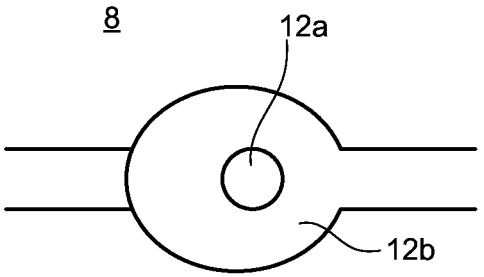
FIG. 4D illustrates an example of the second thermal coupling part of Embodiment 1 of the present invention.
Figure 4B:
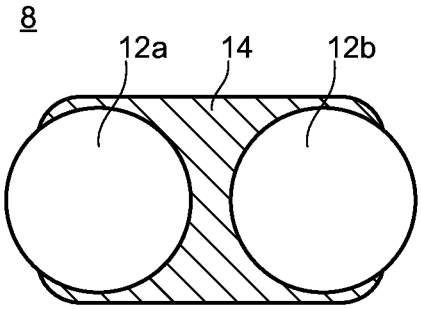
FIG. 4B illustrates an example of the second thermal coupling part of Embodiment 1 of the present invention.

FIGS. 4A and 4B illustrate another example of second thermal coupling part 8. Second thermal coupling part 8 illustrated in FIG. 4A or FIG. 4B mechanically and thermally couples outlet pipe 12*b* and inlet pipe 12*a* with a highly heat conductive member (copper or the like).

Second thermal coupling part 8 illustrated in FIG. 4A thermally couples outlet pipe 12*b* and inlet pipe 12*a* by bundling outlet pipe 12*b* and inlet pipe 12*a* with heat conduction member 14.

Second thermal coupling part 8 illustrated in FIG. 4B thermally couples outlet pipe 12*b* and inlet pipe 12*a* by filling a region including the gap between outlet pipe 12*b* and inlet pipe 12*a* with heat conduction member 14.

Figure 4E:
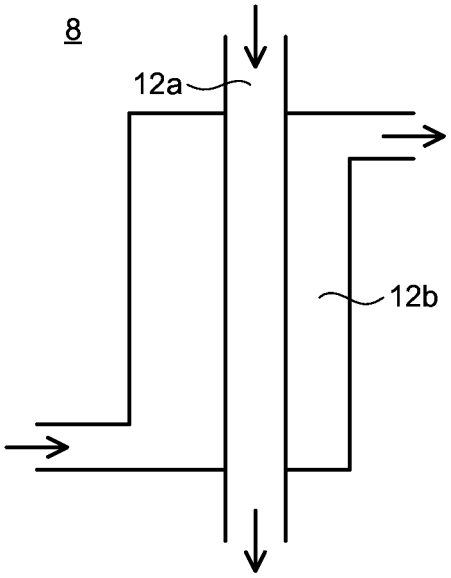
FIG. 4E illustrates an example of the second thermal coupling part of Embodiment 1 of the present invention.
Figure 4C:
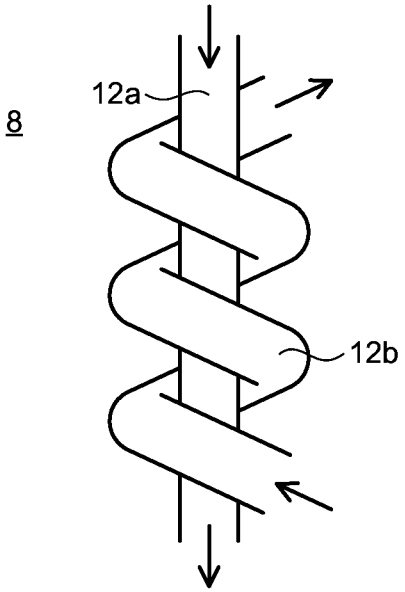
FIG. 4C illustrates an example of the second thermal coupling part of Embodiment 1 of the present invention.

FIG. 4C to FIG. 4E illustrate another examples of second thermal coupling part 8. FIG. 4C is a side view of second thermal coupling part 8. Second thermal coupling part 8 illustrated in FIG. 4C thermally couples outlet pipe 12*b* and inlet pipe 12*a* by winding outlet pipe 12*b* around the outer periphery of linearly extending inlet pipe 12*a*.

FIG. 4D is a plan view of second thermal coupling part 8. FIG. 4E is a sectional view of second thermal coupling part 8. Second thermal coupling part 8 illustrated in FIG. 4D and FIG. 4E thermally couples outlet pipe 12*b* and inlet pipe 12*a* by covering linearly extending inlet pipe 12*a* with outlet pipe 12*b*. In other words, linearly extending inlet pipe 12*a* is disposed in outlet pipe 12*b*. It is to be noted that the combination of thermal coupling parts 8 illustrated in FIG. 3A to FIG. 4E may be adopted.

Effect

With the above-mentioned configuration, in the defrosting operation, the liquid refrigerant is retained in the lower portion of evaporator 5, and vaporized by the heat of defrosting heater 6. Since the vaporized refrigerant is output through returning vertical pipe 11, the temperature of the pipe on the relatively outlet side is equal to the saturation temperature of the refrigerant. In comparison with the outlet side, the portion where no fin is provided in the upper portion of evaporator 5 in inlet pipe 12*a* receives less heat of heater 6, and, since that portion has a lowest temperature, the frosting amount is large and temperature rise is slow in that portion. Temperature rise can be facilitated by second thermal coupling part 8 thermally coupling the above-mentioned portion of inlet pipe 12*a* and outlet pipe 12*b* heated with the vaporized refrigerant. As a result, temperature variation in evaporator 5 can be suppressed in its entirety. Thus, the heat of defrosting heater 6 is not wasted, and inlet pipe 12*a* of evaporator 5, which has been difficult to heat in the related art, can be heated with the latent heat of refrigerant condensation.

While evaporator 5 has a piping configuration in which inlet pipe 12*a* is disposed in the upper portion and outlet pipe 12*b* is disposed in the lower portion in the present embodiment, a configuration in which the upper and lower portions are reversed may also achieve the same effect.

Embodiment 2

Figure 5:
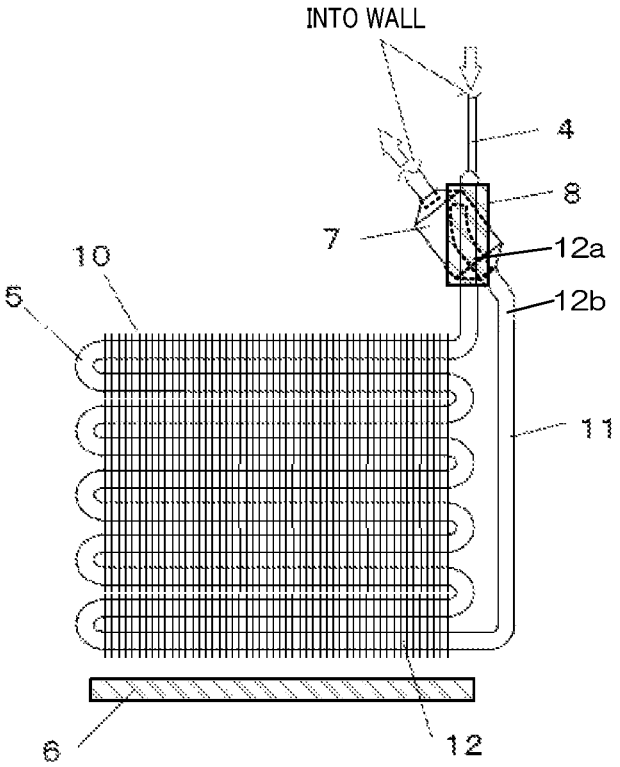
FIG. 5 is a front view illustrating thermal coupling between an inlet pipe and an accumulator in an evaporator of Embodiment 2 of the present invention.

FIG. 5 is a piping diagram illustrating evaporator 5 of Embodiment 2 of the present invention as viewed from the front. In FIG. 5, the components identical to those of FIG. 1 and FIG. 2 are denoted with the same reference numerals, and the description thereof is omitted. The parts not illustrated are the same as in Embodiment 1.

Evaporator 5 is a heat exchanger of a fin-and-tube type of ten-folds in the vertical direction and one-line in the front-rear direction, and fin 10 is schematically illustrated in this diagram. In the cooling operation, the liquid refrigerant builds up in a lower portion of returning vertical pipe 11 with gravity. Accumulator 7 is disposed for the purpose of preventing liquid compression due to the above-mentioned liquid refrigerant returning to compressor 1. The outer frame of accumulator 7 and a part of inlet pipe 12*a* are thermally coupled with each other by second thermal coupling part 8.

It is to be noted that second thermal coupling part 8 may have a configuration in which the outer frame of accumulator 7 and inlet pipe 12*a* are welded together, a configuration in which inlet pipe 12*a* is wound around the outer frame of accumulator 7, or a combination of such configurations.

Effect

With the above-mentioned configuration, in the defrosting operation, refrigerant that is built up in a lower portion of evaporator 5 in a liquid state and is vaporized by the heat of defrosting heater 6 passes through returning vertical pipe 11 and is then condensed at accumulator 7. Accordingly, the rising temperature of the accumulator 7 and the pipe on relatively outlet side is equal to the saturation temperature of the refrigerant. In comparison with the outlet side, the entrance side pipe of the upper portion of evaporator 5 where no fin is provided receives less heat of the heater, has a lowest temperature, and therefore generates a large amount of frosting, thus resulting in slow temperature rise. By thermally coupling this portion with accumulator 7 heated with the vaporized refrigerant and having larger heat capacity than the pipe part to facilitate temperature rise, temperature variation of the entire evaporator 5 can be suppressed.

In this manner, the heat of defrosting heater 6 used for vaporization of refrigerant is not wasted, and the entrance part of evaporator 5, which is difficult to heat in the related art, can be heated with the condensation latent heat of the refrigerant.

Embodiment 3

Figure 6:
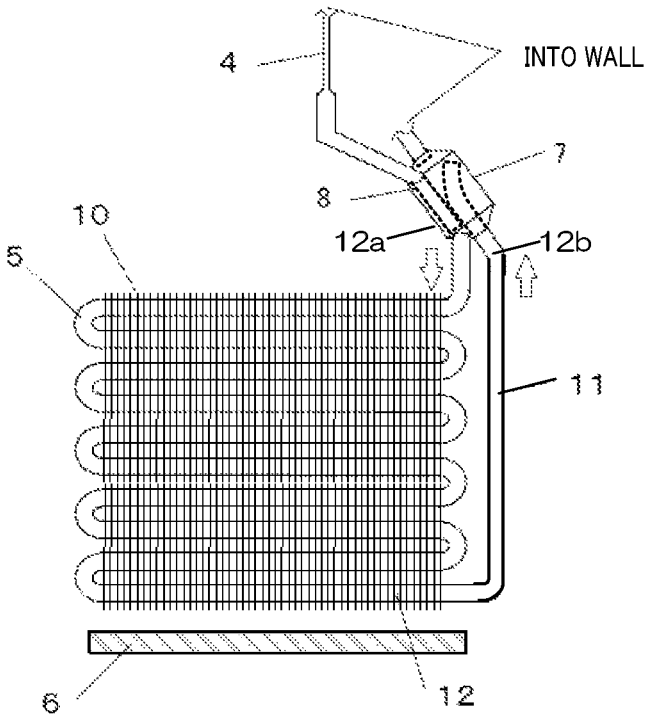
FIG. 6 is a front view illustrating a configuration in which an inlet pipe is inserted in an accumulator in an evaporator in Embodiment 3 of the present invention.
Figure 7:
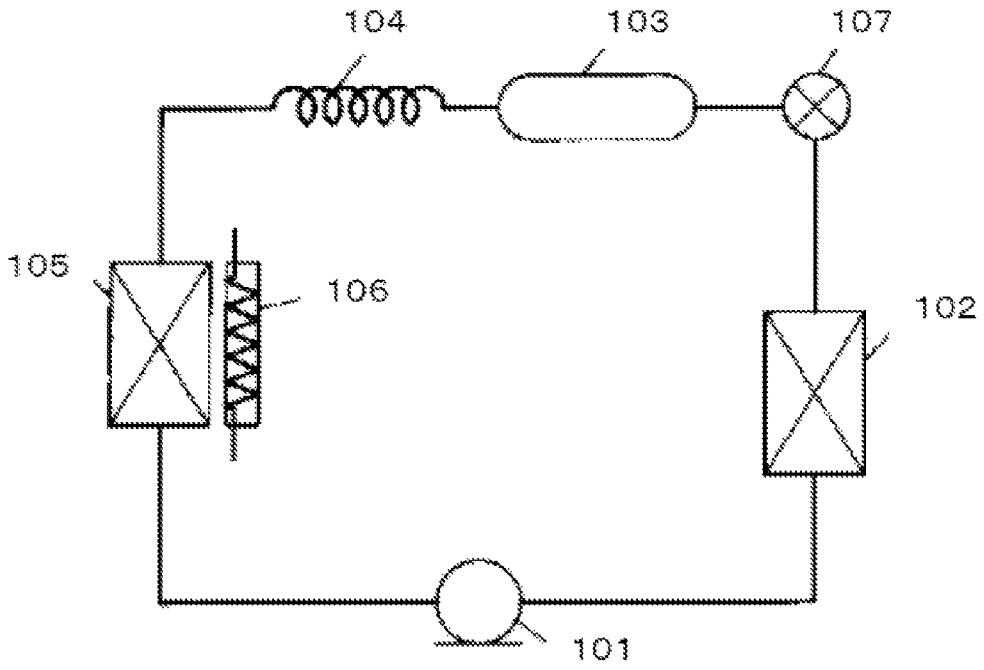
FIG. 7 is a freezing cycle piping diagram illustrating a defrosting method of a conventional freezing refrigerator disclosed in PTL 1.

FIG. 6 is a piping diagram illustrating evaporator 5 of Embodiment 3 of the present invention as viewed from the front. In FIG. 6, the components identical to those of FIGS. 1 to 3 are denoted with the same reference numerals, and the description thereof is omitted. The parts not illustrated are the same as in Embodiments 1 and 2.

Evaporator 5 is a heat exchanger of a fin-and-tube type of ten-folds in the vertical direction and one-line in the front-rear direction, and fin 10 is schematically illustrated in this diagram. Accumulator 7 which prevents returning of liquid refrigerant to compressor 1 is disposed in returning vertical pipe 11. A part of inlet pipe 12*a* passes through the inside of accumulator 7.

Effect

With the above-mentioned configuration, in the defrosting operation, refrigerant that is built up in a lower portion of evaporator 5 in a liquid state and is vaporized by the heat of defrosting heater 6 passes through returning vertical pipe 11 and is then condensed at accumulator 7. Accordingly, the rising temperature of the accumulator 7 and the pipe on relatively outlet side is equal to the saturation temperature of the refrigerant. In comparison with the outlet side, the entrance side pipe of the upper portion of evaporator 5 where no fin is provided receives less heat of the heater, has a lowest temperature, and therefore generates a large amount of frosting, thus resulting in slow temperature rise. With the configuration in which the above-mentioned portion passes through accumulator 7 heated with vaporized refrigerant and having larger heat capacity than the pipe part, frosting is suppressed in the cooling operation, and temperature rise is facilitated in the defrosting operation, whereby temperature variation of the entire evaporator in defrosting can be suppressed. In this manner, the heat of defrosting heater 6 used for vaporization of refrigerant is not wasted, and the entrance part of evaporator 5, which is difficult to heat in the related art, can be heated with the condensation latent heat of the refrigerant.

While the coupling part for thermally coupling inlet pipe 12*a* and outlet pipe 12*b* together in the heat exchanger in which a horizontal pipe folded by a predetermined number of times in the vertical direction is arranged in a predetermined number of lines in the front-rear direction is described in the above-mentioned embodiments, the present invention is not limited to this. For example, the coupling part may thermally couple inlet pipe 12*a* and outlet pipe 12*b* together in a heat exchanger including a horizontal pipe which is arranged in a predetermined number of lines in the front-rear direction and folded by a predetermined number of times in the vertical direction.

INDUSTRIAL APPLICABILITY

The freezing refrigerator of the subject application can be widely used not only as a home-use freezing refrigerator, but also as a business-grade freezing refrigerator. Further, the freezing refrigerator of the subject application can be used as a freezing refrigerator of a mobile machine such as an automobile and a ship.

REFERENCE SIGNS LIST

1 Compressor
2 Condenser
3 Dryer
4 Decompressor (Capillary tube)
5 Evaporator
6 Defrosting heater
7 Accumulator
8 Second thermal coupling part
9 First thermal coupling part
10 Fin
11 Returning vertical pipe
12 Pipe
12*a* Inlet pipe
12*b* Outlet pipe
13 Expanding portion
14 Heat conduction member
15 Welding part
16 Pipe
16*a* First pipe
16*b* Second pipe
18 Pipe line
19 Pipe of end portion
101 Compressor
102 Condenser
103 Dryer
104 Decompressor (Capillary tube)
105 Evaporator
106 Electric heater
107 Inflow prevention valve

The invention claimed is:

1. A freezing refrigerator comprising:
a compressor;
a condenser;
a dryer;
a decompressor;
an evaporator;
a first pipe including an inlet pipe of the evaporator;
a second pipe including an outlet pipe of the evaporator;
a first thermal coupling member which thermally couples the decompressor and the second pipe together; and
a second thermal coupling member which thermally couples the first pipe and the second pipe together, wherein
the compressor, the condenser, the dryer, the decompressor and the evaporator configure a refrigerant cycle,
an entrance of the evaporator is disposed at an upper portion of an entirety of the evaporator;
a pipe of the evaporator includes a plurality of pipe lines, each pipe line being one pipe which extends in a vertical direction while horizontally meandering by a predetermined number of times, the plurality of pipe lines being arranged in a front-rear direction orthogonal to the vertical direction and the horizontal direction;
a fin for facilitating heat exchange is attached to the pipe; and
the second thermal coupling member thermally couples a returning vertical pipe with the inlet pipe of the evaporator, the returning vertical pipe extending from a lower side to an upper side and being communicated with a pipe of an end portion disposed at a position closest to an outlet of the evaporator when a number of the pipe line is an odd number.

2. The freezing refrigerator according to claim 1,
wherein the first pipe includes an expanding portion, and
wherein a pipe diameter downstream of the expanding portion is greater than a pipe diameter upstream of the expanding portion.

3. The freezing refrigerator according to claim 2, wherein the second thermal coupling member is located on the evaporator side after the expanding portion.

4. The freezing refrigerator according to claim 1, wherein the second thermal coupling member thermally couples an accumulator provided in an outlet pipe of the evaporator and an inlet pipe of the evaporator together.

5. The freezing refrigerator according to claim 1, wherein the second coupling member includes:

an accumulator provided in an outlet pipe of the evaporator; and an inlet pipe of the evaporator, the inlet pipe passing through inside of the accumulator.

* * * * *